US005482754A

United States Patent [19]

Crook

[11] Patent Number: 5,482,754

[45] Date of Patent: Jan. 9, 1996

[54] MULTI-LAYER RUBBER MAT

[76] Inventor: Carol A. Crook, 1717 Ashley Dr., Virginia Beach, Va. 23454

[21] Appl. No.: 282,235

[22] Filed: Jul. 29, 1994

[51] Int. Cl.[6] ..... B32B 3/10

[52] U.S. Cl. ..... 428/54; 428/903.3; 428/911; 102/303

[58] Field of Search ..... 52/177; 428/53, 428/54, 903.3, 911; 102/303

[56] References Cited

U.S. PATENT DOCUMENTS

| | | | |
|---|---|---|---|
| 2,327,624 | 8/1943 | Denman | 52/177 |
| 3,371,604 | 3/1968 | Wikner et al. | 102/22 |
| 3,793,953 | 2/1974 | Lewis | 102/22 |
| 3,943,853 | 3/1976 | Robertson et al. | 102/22 |
| 3,945,319 | 3/1976 | Meagher | 102/303 |
| 4,315,463 | 2/1982 | Arcand | 102/303 |

*Primary Examiner*—Alexander S. Thomas

[57] ABSTRACT

A multi-purpose rubber mat comprising strips of rubber material having a top and bottom sides and edge portion; said strips laid together whereby the top side of one abuts the bottom side of another; and said laid together strips threaded and held together to form a barrier surface to contain flying objects.

6 Claims, 1 Drawing Sheet

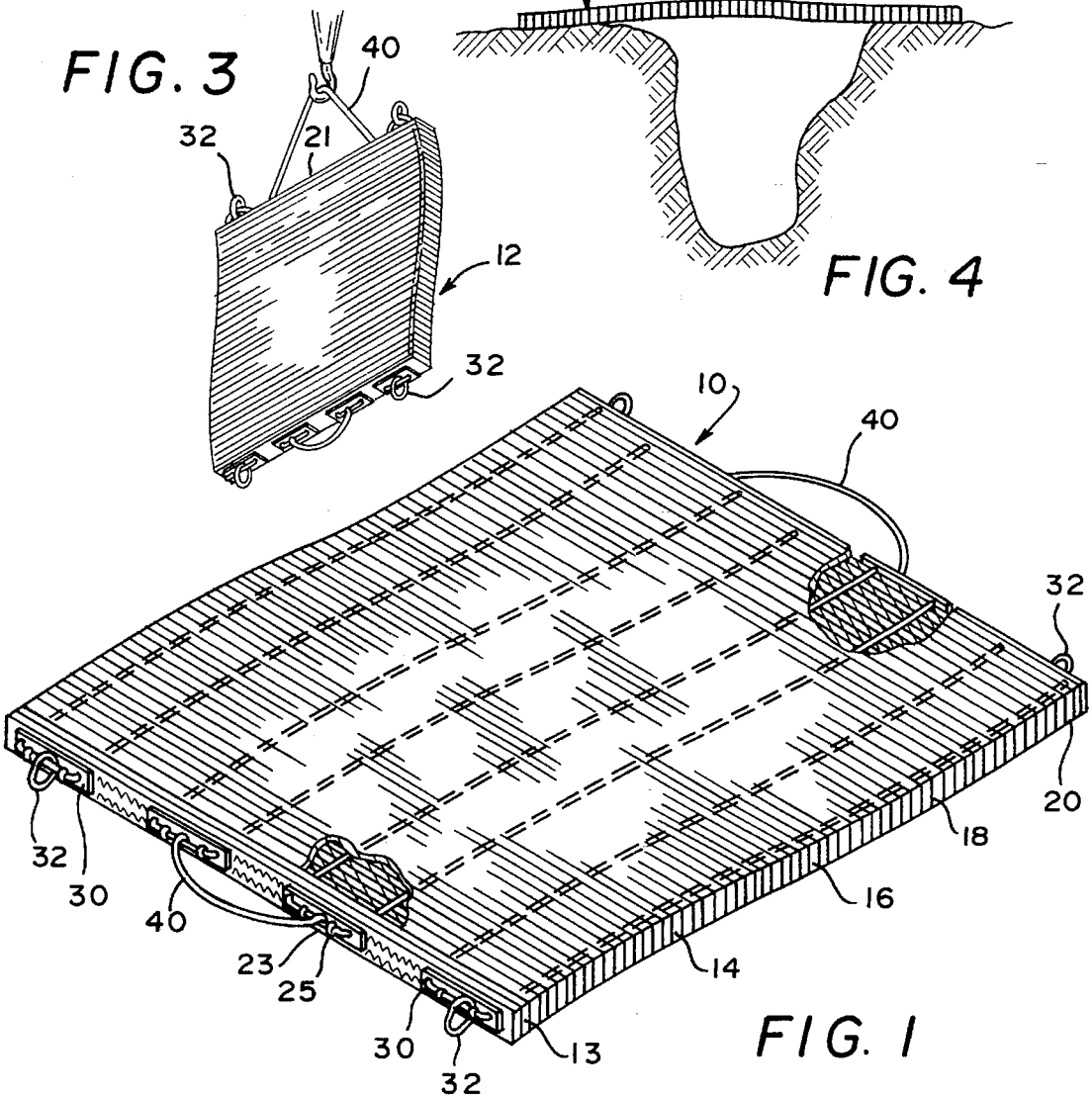
FIG. 3
40
32
21
12
32
12
FIG. 4
10
40
32
20
18
16
14
13
32
30
40
23
25
30
32
FIG. 1
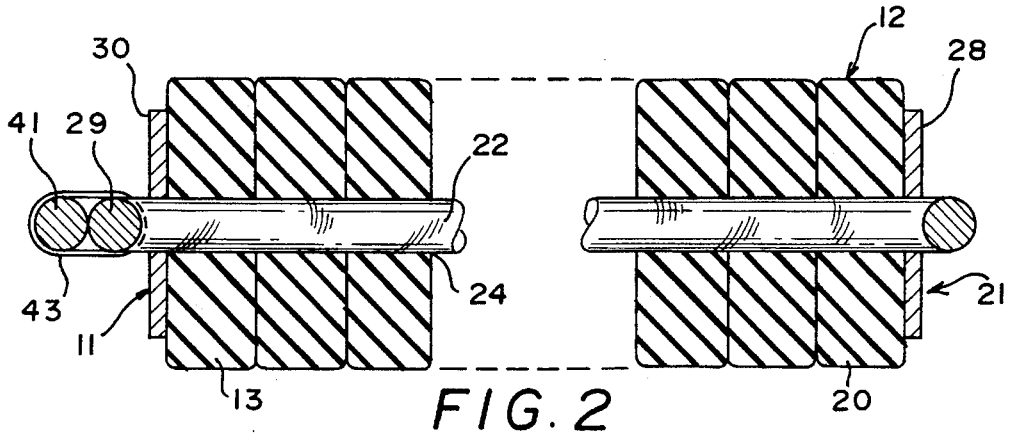
30
41
29
43
11
13
22
24
12
28
21
20
FIG. 2

MULTI-LAYER RUBBER MAT

BACKGROUND OF THE INVENTION

1. Field of the Invention

This invention pertains to rubber mats and specifically to multi-layer rubber mats having general use as a blasting mat, barrier curtain and ground cover.

2. Background of the Prior Art

Blasting mats are well known in the construction industry. Such mats are shown and described in U.S. Pat. Nos. 4,315,463; 3,945,319; 3,943,853; 3,793,953; and 3,371,694.

One problem with these structures is that they are very cumbersome and difficult to handle. Indeed, some must be assembled on job sites.

Another problem with some of these mats is that their constructions permits spaces between which flying rock and debris may pass causing injury to workers.

SUMMARY OF THE INVENTION

The disadvantages of the above patents may be corrected by constructing these mats from recyclable strips of rubber truck tire threads and laying the strips flat on top of each other so that the resulting structure is light in weight and simple to construct.

It is thus a major object of this invention to construct a multi-layer rubber mat which is light in weight and easy to move from place to place.

It is another object of this invention to construct a multi-layer mat from strips of rubber truck tire threads laid flat against each other so that no spaces occur between the strips thus preventing the escape of flying objects such as rock where the mat is used in a blasting environment.

It is another object of this invention to provide a multi-layer rubber mat consisting of multiple layers of flat strips of rubber truck tire threads laid flat against each other and threaded with wire rope such that the completed mat is useful as a barrier curtain to contain flying rock in blasting operations, and to contain noise as in firing ranges.

And another object of this invention is to provide a multi-layer rubber mat which may be used as a ground cover to support heavy equipment such as trucks and the like.

These and other objects of this invention will become apparent from a reading of the following specifications when taken with the annexed drawings.

BRIEF DESCRIPTION OF THE DRAWINGS

FIG. 1 is a perspective view of the mat showing multiple layers of flat strips of rubber tire laid flat against each other and threaded with wire rope.

FIG. 2 is an end view of the multi-layer rubber mat showing strips of flat rubber tire having a wire rope threaded therethrough.

FIG. 3 is a perspective view of the rubber mat showing end plates and clamps for the threaded cable and cable loops for lifting.

FIG. 4 is an end view of the mat laid over the ground. This may be rocky ground to be blasted.

DETAILED DESCRIPTION OF THE PREFERRED EMBODIMENT OF THE INVENTION

Referring now in more detail to the drawings, FIG. 1 shows a mat 10 made from truck tire threads. The tire is cut into sections and hydraulically compressed to form individual strips 12 having a dimension of 4½" thick and 1¼" wide. The completed mat is from 2' up to 10' wide and up to 22' or longer in length. The individual strips 12 are laid against each other to form a mat having multiple layers 13–20, for example. It will be appreciated that there may be more or less layers depending on the size mat desired.

The layers of strips 13–20are laid flat against each other and held tightly together by threading wire rope 22 through holes 24 cut in each strip 12. The strips 13–20 have end plates 28 at one end and end plates 30 at the other end. The plates 30 are held by loop portion 29 of the rope 22 at end 11. The ends 23 of the wire rope are fastened by clamps 25. And rings 32 in the plates 28 and 30 function to receive a hook of the lifting mechanism, FIG. 3.

In addition, a wire cable 40 is attached at its ends 41 to the loop portions 29 to form a loop to lift the mat. Clamps 43 hold the ends 41 to loop portions 29.

It will be seen, FIG. 2, that the strips 13–20 are compressed together so that no spaces appear between the strips. This is to ensure that no flying rock or debris will escape when the mat is used over blasting areas. Further, the width of the strips are much greater than the dimensions of the wire rope 22 so that the wire rope does not contact blasting caps and short them.

It will be appreciated that the finished mat 12 is flexible in all planes to provide a versatile device having many functions.

One function is as a blasting mat to contain flying rock.

Another function is as a barrier curtain to contain flying rock and attenuate noise.

Another function is as a ground support for heavy vehicles.

While the invention has been described with regard to a specific construction, it will be apparent to those skilled in the art to which the invention pertains that various modifications may be made therein without departing from the scope thereof.

What I claimed is:

1. A blasting mat comprising:

strips of material having top and bottom sides and edge portions;

said strips being flexible in all planes and laid together whereby the top side of one abuts the bottom side of another;

said strips being at least 4½" thick and 1¼" wide;

said laid together strips forming a continuous non-open surface and threadedly held together to form a closed barrier surface to contain flying objects; and said strips being thin flat strips of compressed truck tire threads laid together to form a mat from 2' to 10' in width and threaded through apertures therein to provide a continuous barrier surface whereby no open spaces occur between said strips thereby containing flying material such as rock.

2. A blasting mat according to claim 1, and said continuous barrier surface is a surface comprising the edge portions of said laid together strips.

3. A blasting mat according to claim 2, wherein:

said continuous barrier is flexible on all planes.

4. A blasting mat according to claim 1, wherein:

said strips have apertures to receive threading material;

plates having apertures laid flat against the tops of said strips;

said plates and said strips having threading material through said apertures; and said threading material fastened by clamps whereby said strips and said plates are held together.

5. A blasting mat according to claim 4, wherein:

said plates having rings to permit the mat to be lifted and moved from place to place.

6. A blasting mat according to claim 5, and a wire loop releasably attached to said plates to aid in lifting the mat.

* * * * *